US005846788A

United States Patent [19]

Pedersen et al.

[11] Patent Number: 5,846,788

[45] Date of Patent: Dec. 8, 1998

[54] PROCESS FOR PREPARING A LIGNOCELLULOSE-BASED PRODUCT, AND PRODUCT OBTAINABLE BY THE PROCESS

[75] Inventors: Lars Saaby Pedersen, Farum; Claus Felby, Herlev, both of Denmark

[73] Assignee: Novo Nordisk A/S, Bagsvaerd, Denmark

[21] Appl. No.: 750,185

[22] PCT Filed: Jul. 26, 1995

[86] PCT No.: PCT/DK95/00318

§ 371 Date: Dec. 3, 1996

§ 102(e) Date: Dec. 3, 1996

[87] PCT Pub. No.: WO96/03546

PCT Pub. Date: Aug. 2, 1996

[30] Foreign Application Priority Data

Jul. 26, 1994 [DK] Denmark ..... 0883/94

[51] Int. Cl.[6] ..... C12P 19/04; C08L 1/02; C08B 15/10

[52] U.S. Cl. ..... 435/101; 435/72; 435/133; 435/156; 106/162.5; 536/123; 536/123.1; 536/126

[58] Field of Search ..... 435/101, 72, 133, 435/156; 106/162.5; 536/123, 123.1, 126

[56] References Cited

U.S. PATENT DOCUMENTS

| | | | |
|---|---|---|---|
| 2,485,587 | 10/1949 | Goss | 106/162.5 |
| 3,093,607 | 6/1963 | Ayers | 106/162.5 |
| 4,432,921 | 2/1984 | Haars et al. . | |
| 5,424,382 | 6/1995 | Meister et al. | 527/400 |
| 5,530,112 | 6/1996 | Greenshields et al. | 536/123.1 |

FOREIGN PATENT DOCUMENTS

| | | |
|---|---|---|
| 0 433 258 A1 | 12/1990 | European Pat. Off. . |
| 0 565 109 A1 | 4/1993 | European Pat. Off. . |
| WO 93/23606 | 11/1993 | WIPO . |

OTHER PUBLICATIONS

Horst, H., "Lingin–Based Wood Adhesives", NIMZ/Polymer Institute, University of Karlsruhe, Federal Republic of Germany, pp. 248–288.

Philippou, John L., "Applicability of Oxidative Systems To Initiate Graphing On And Bonding Of Wood". Journal of Wood Chemistry And Technology, 1(2), 199–227 (1981), pp. 199–221.

Haars et al., "Room–Temperature Curing Adhesives Based on Lignin and Phenoloxidases" (Chapter 10), American Chemical Society, pp. 126–134.

Roffael et al., et al., "Lignin And Ligninsulfonate In Non–Conventional Bonding–An Overview", Holz als Roh–Und Werkstoff (1991), pp. 199–205.

*Primary Examiner*—Francisco C. Prats
*Attorney, Agent, or Firm*—Steve T. Zelson; Valeta Gregg

[57] ABSTRACT

A process for the manufacture of a lignocellulose-based product from a lignocellulosic material comprises treating the lignocellulosic material and a phenolic polysaccharide having substituents containing a phenolic hydroxy group with an enzyme capable of catalyzing the oxidation of phenolic groups in the presence of an oxidizing agent.

24 Claims, No Drawings

PROCESS FOR PREPARING A LIGNOCELLULOSE-BASED PRODUCT, AND PRODUCT OBTAINABLE BY THE PROCESS

CROSS-REFERENCE TO RELATED APPLICATIONS

This application is a 35 U.S.C. 371 national application of PCT/DK95/00318 filed 26 Jul. 1995, which is incorporated herein by reference.

FIELD OF THE INVENTION

The present invention provides a process for producing a lignocellulose-based product, e.g. fibre board [such as hardboard or medium-density fibre board ("MDF")], particle board, plywood, paper or paperboard (such as cardboard and linerboard), from an appropriate lignocellulosic starting material, such as vegetable fibre, wood chips, wood flakes, etc. The use of the process of the invention confers excellent tensile, tear and compression strength on lignocellulose-based products prepared thereby, especially paper products such as liner board, cardboard and corrugated board.

BACKGROUND AND BRIEF DESCRIPTION OF THE INVENTION

Lignocellulose-based products prepared from lignocellulosic starting materials, notably products manufactured starting from vegetable fibre (e.g. wood fibre) prepared by mechanical or mechanical/chemical procedures (the latter often being denoted "semi-chemical" procedures), or by a chemical procedure without bleaching, or from wood particles (wood "chips", flakes and the like), are indispensable everyday materials. Some of the most familiar types of such products include paper for writing or printing, cardboard, corrugated cardboard, fibre board (e.g. "hardboard"), and particle board.

Virtually all grades of paper, cardboard and the like are produced from aqueous pulp slurry. Typically, the pulp is suspended in water, mixed with various additives and then passed to equipment in which the paper, cardboard etc. is formed, pressed and dried. Irrespective of whether mechanically produced pulp (hereafter denoted "mechanical pulp"), semi-chemically produced pulp (hereafter denoted "semi-chemical pulp"), unbleached chemical pulp or pulp made from recycled fibres (i.e. pulp prepared from recycled paper, rags and the like) is employed, it is often necessary to add various strengthening agents to the pulp in order to obtain an end product having adequate strength properties. In the case of paper and board for use in packaging and the like, the tensile strength and tear strength under dry and wet conditions are of primary importance; moreover, notably in the case of certain grades of cardboard (e.g. so-called unbleached board for the manufacture of corrugated cardboard boxes for packaging, transport and the like), the compression strength of the material is often also an important factor. Among the strengthening agents used today there are a number of environmentally undesirable substances which it would be desirable to replace by more environmentally acceptable materials. As examples hereof may be mentioned epichlorohydrin, urea-formaldehyde and melamine-formaldehyde.

In the case of "traditional" lignocellulose-based composites for use in building construction, flooring, cladding, furniture, packaging and the like, such as hardboard (which is normally made from wood fibres produced by mechanical or semi-chemical means or by so-called "steam explosion") and particle board (which is made from relatively coarse wood particles, fragments or "chips"), binding of the wood fibres or particles to give a coherent mass exhibiting satisfactory strength properties can be achieved using a process in which the fibres/particles are treated—optionally in a mixture with one or more "extenders", such as lignosulfonates and/or kraft lignin—with synthetic adhesives (typically adhesives of the urea-formaldehyde, phenol-formaldehyde or isocyanate type) and then pressed into the desired form (boards, sheets, panels etc.) with the application of heat.

The use of synthetic adhesives of the above-mentioned types in the production of wood products is, however, generally undesirable from an environmental and/or safety point of view, since many such adhesives are directly toxic—and therefore require special handling precautions—and/or can at a later stage give rise to release of toxic and/or environmentally harmful substances; thus, for example, the release of formaldehyde from certain cured formaldehyde-based adhesives (used as binders in, e.g., particle board and the like) has been demonstrated.

In the light of the drawbacks associated with the use of synthetic adhesives as binders in the manufacture of lignocellulose-based products, considerable effort has been devoted in recent years to the development of binder systems and binding processes which are more acceptable from an environmental and toxicity point of view, and relevant patent literature in this respect includes the following:

EP 0 433 258 A1 discloses a procedure for the production of mechanical pulp from a fibrous product using a chemical and/or enzymatic treatment in which a "binding agent" is linked with the lignin in the fibrous product via the formation of radicals on the lignin part of the fibrous product. This document mentions "hydrocarbonates", such as cationic starch, and/or proteins as examples of suitable binding agents. As examples of suitable enzymes are mentioned laccase, lignin peroxidase and manganese peroxidase, and as examples of suitable chemical agents are mentioned hydrogen peroxide with ferro ions, chlorine dioxide, ozone, and mixtures thereof.

EP 0 565 109 A1 discloses a method for achieving binding of mechanically produced wood fragments via activation of the lignin in the middle lamella of the wood cells by incubation with phenol-oxidizing enzymes. The use of a separate binder is thus avoided by this method.

U.S. Pat. No. 4,432,921 describes a process for producing a binder for wood products from a phenolic compound having phenolic groups, and the process in question involves treating the phenolic compound with enzymes to activate and oxidatively polymerize the phenolic compound, thereby converting it into the binder. The only phenolic compounds which are specifically mentioned in this document, or employed in the working examples given therein, are lignin sulfonates, and a main purpose of the invention described in U.S. Pat. No. 4,432,921 is the economic exploitation of so-called "sulfite spent liquor", which is a liquid waste product produced in large quantities through the operation of the widely-used sulfite process for the production of chemical pulp, and which contains lignin sulfonates.

With respect to the use of lignin sulfonates—in particular in the form of sulfite spent liquor—as phenolic polymers in systems/processes for binding wood products (as described in U.S. Pat. No. 4,432,921), the following comments are appropriate:

(i) subsequent work (see H. H. Nimz in *Wood Adhesives, Chemistry and Technology*, Marcel Dekker, New York and Basel 1983, pp. 247–288), and A Haars et al. in *Adhesives from Renewable Resources, ACS Symposium Series* 385, American Chemical Society 1989, pp. 126–134) has demonstrated that by comparison with the amounts of "traditional" synthetic adhesives which are required in the manufacture of wood-based boards, very large amounts of lignin sulfonates are required in order to achieve comparable strength properties;

(ii) the pressing time required when pressing wood-based board products prepared using lignin sulfonate binders has been found to be very long [see E. Roffael and B. Dix, *Holz als Roh- und Werkstoff* 49 (1991) 199–205];

(iii) lignin sulfonates available on a commercial scale are generally very impure and of very variable quality [see J. L. Philippou, *Journal of Wood Chemistry and Technology* 1(2) (1981) 199–227];

(iv) the very dark colour of spent sulfite liquor renders it unsuited as a source of lignin sulfonates for the production of, e.g., paper products (such as packaging paper, linerboard or unbleached board for cardboard boxes and the like) having acceptable colour properties.

The present inventors have surprisingly found that binding of lignocellulosic materials (vegetable fibres, wood chips, etc.) using a combination of a polysaccharide having at least substituents containing a phenolic hydroxy group (in the following often simply denoted a "phenolic polysaccharide"), an oxidizing agent and an enzyme capable of catalyzing the oxidation of phenolic groups by the oxidizing agent can be employed in the manufacture of lignocellulose-based products exhibiting strength properties at least comparable to, and often significantly better than, those achievable using previously known processes which have attempted to reduce or avoid the use of toxic and/or otherwise harmful substances [such as the processes described in EP 0 433 258 A1, EP 0 565 109 A1 and U.S. Pat. No. 4,432,921 (vide supra)].

Thus, for example, the amount of binder required to prepare lignocellulose-based products of very satisfactory strength by the process of the present invention is generally much lower typically by a factor of about three or more—than the level of binder (based on lignin sulfonate) required to obtain comparable strength properties using the process according to U.S. Pat. No. 4,432,921. The process according to the present invention can thus not only provide an environmentally attractive alternative to more traditional binding processes employing synthetic adhesives, but it can probably also compete economically with such processes.

DETAILED DESCRIPTION OF THE INVENTION

The present invention thus provides a process for the manufacture of a lignocellulose-based product from a lignocellulosic material, the process comprising treating said lignocellulosic material and a phenolic polysaccharide (i.e. a polysaccharide which is substituted with at least substituents containing a phenolic hydroxy group) with an enzyme capable of catalyzing the oxidation of phenolic groups in the presence of an oxidizing agent.

The order of mixing/contacting the four components, i.e. the lignocellulosic material, the phenolic polysaccharide, the enzyme and the oxidizing agent, is unimportant as long as the process set-up ensures that the activated lignocellulosic material and the activated phenolic polysaccharide are brought together in a way that enables them to react in the desired manner. Thus, for example, the enzyme and the oxidizing agent may be mixed with the lignocellulosic material before or after being mixed with the phenolic polysaccharide.

It will generally be appropriate to incubate the reaction medium (containing the lignocellulosic material, phenolic polysaccharide and enzyme in the presence of oxidizing agent) for a period of at least a few minutes. An incubation time of from 1 minute to 10 hours will generally be suitable, although a period of from 1 minute to 2 hours is preferable.

As already indicated, the process of the invention is well suited to the production of all types of lignocellulose-based products, e.g. various types of fibre board (such as hardboard), particle board, flakeboard [such as oriented-strand board ("OSB")], plywood, moulded composites (e.g. shaped articles based on wood particles, often in combination with other, non-lignocellulosic materials, e.g. certain plastics), paper and paperboard (such as cardboard, linerboard and the like).

The lignocellulosic starting material employed in the method of the invention can be in any appropriate form, e.g. in the form of vegetable fibre (such as wood fibre), wood chips, wood flakes or wood veneer, depending on the type of product to be manufactured. If appropriate, a lignocellulosic material can be used in combination with a non-lignocellulosic material having phenolic hydroxy functionalities. Using the process of the invention, intermolecular linkages between the lignocellulosic material and the non-lignocellulosic material, respectively, may then be formed (i.e. in a manner analogous to that in which intermolecular linkages are formed when lignocellulosic materials alone are employed in the process), resulting in a composite product. Besides functioning as a good adhesive/binder, the phenolic polysaccharide also serves as a good "gap-filler", which is a big advantage when producing, e.g., particle boards from large wood particles.

It will normally be appropriate to employ the lignocellulosic material in question in an amount corresponding to a weight percentage of dry lignocellulosic material [dry substance (DS)] in the medium in the range of 0.1–90%.

The temperature of the reaction mixture in the process of the invention may suitably be in the range of 10°–120° C., as appropriate; however, a temperature in the range of 15°–90° C. is generally to be preferred. As illustrated by the working examples provided herein (vide infra), the reactions involved in a process of the invention may take place very satisfactorily at ambient temperatures around 20° C.

Phenolic Polysaccharides

The phenolic polysaccharides employed in the process of the invention may suitably be materials obtainable from natural sources (vide infra) or polysaccharides which have been chemically modified by the introduction of substituents having phenolic hydroxy groups. Examples of the latter category are modified starches containing phenolic substituents, e.g. acyl-type substituents derived from hydroxy-substituted benzoic acids (such as, e.g., 2-, 3- or 4-hydroxybenzoic acid).

The phenolic substituent(s) in phenolic polysaccharides suited for use in the context of the present invention may suitably be linked to the polysaccharide species by, e.g., ester linkages or ether linkages.

Very suitable phenolic polysaccharides are those in which the phenolic substituent of the phenolic polysaccharide is a substituent derived from a phenolic compound which occurs in at least one of the following plant-biosynthetic pathways: from p-coumaric acid to p-coumaryl alcohol, from p-coumaric acid to coniferyl alcohol and from p-coumaric acid to sinapyl alcohol; p-coumaric acid itself and the three mentioned "end products" of the latter three biosynthetic pathways are also relevant compounds in this respect. Examples of relevant "intermediate" compounds formed in these biosynthetic pathways include caffeic acid, ferulic acid (i.e. 4-hydroxy-3-methoxycinnamic acid), 5-hydroxyferulic acid and sinapic acid.

Particularly suitable phenolic polysaccharides are those which exhibit good solubility in water, and thereby in aqueous media in the context of the invention. In this and other respects, a number of types of phenolic polysaccharides which are readily obtainable in uniform quality from vegetable sources have been found to be particularly well-suited for use in the process of the present invention. These include, but are in no way limited to, phenolic arabino- and heteroxylans, and phenolic pectins. Very suitable examples hereof are ferulylated arabinoxylans (obtainable, e.g., from wheat bran or maize bran) and ferulylated pectins (obtainable from, e.g., beet pulp), i.e. arabinoxylans and pectins containing ferulyl substituents attached via ester linkages to the polysaccharide molecules.

The amount of phenolic polysaccharide employed in the process of the invention will generally be in the range of 0.01–10 weight per cent, based on the weight of lignocellulosic material (calculated as dry lignocellulosic material), and amounts in the range of about 0.02–6 weight per cent (calculated in this manner) will often be very suitable.

Enzymes

In principle, any type of enzyme capable of catalyzing oxidation of phenolic groups may be employed in the process of the invention. Preferred enzymes are, however, oxidases [e.g. laccases (EC 1.10.3.2), catechol oxidases (EC 1.10.3.1) and bilirubin oxidases (EC 1.3.3.5)] and peroxidases (EC 1.11.1.7). In some cases it may be appropriate to employ two or more different enzymes in the process of the invention.

Among types of oxidases (in combination with which oxygen—e.g. atmospheric oxygen—is an excellent oxidizing agent), laccases have proved to be well suited for use in the method of the invention.

Laccases are obtainable from a variety of microbial sources, notably bacteria and fungi (including filamentous fungi and yeasts), and suitable examples of laccases include those obtainable from strains of Aspergillus, Neurospora (e.g. *N. crassa*), Podospora, Botrytis, Collybia, Fomes, Lentinus, Pleurotus, Trametes [some species/strains of which are known by various names and/or have previously been classified within other genera; e.g. *Trametes villosa*=*T. pinsitus*=*Polyporus pinsitis* (also known as *P. pinsitus* or *P. villosus*)=*Coriolus pinsitus*], Polyporus, Rhizoctonia (e.g. *R. solani*), Coprinus (e.g. *C. plicatilis*), Psatyrella, Myceliophthora (e.g. *M. thermophila*), Schytalidium, Phlebia (e.g. *P. radita*; see WO 92/01046), or Coriolus (e.g. *C.hirsutus*; see JP 2-238885).

A preferred laccase in the context of the invention is that obtainable from *Trametes villosa*.

Peroxidase enzymes (EC 1.11.1) employed in the method of the invention are preferably peroxidases obtainable from plants (e.g. horseradish peroxidase or soy bean peroxidase) or from microorganisms, such as fungi or bacteria. In this respect, some preferred fungi include strains belonging to the sub-division Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes*.

Other preferred fungi include strains belonging to the sub-division Basidiomycotina, class Basidiomycetes, e.g. Coprinus, Phanerochaete, Coriolus or Trametes, in particular *Coprinus cinereus f. microsporus* (IFO 8371), *Coprinus macrorhizus, Phanerochaete chrysosporium* (e.g. NA-12) or *Trametes versicolor* (e.g. PR4 28-A).

Further preferred fungi include strains belonging to the sub-division Zygomycotina, class Mycoraceae, e.g. Rhizopus or Mucor, in particular *Mucor hiemalis*.

Some preferred bacteria include strains of the order Actinomycetales, e.g. *Streptomyces spheroides* (ATTC 23965), *Streptomyces thermoviolaceus* (IFO 12382) or *Streptoverticillum verticillium ssp.* verticillium.

Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g. *M. virescens*.

Other potential sources of useful particular peroxidases are listed in B. C. Saunders et al., *Peroxidase*, London 1964, pp. 41–43.

When employing laccases in the process of the invention, an amount of laccase in the range of 0.02–2000 laccase units (LACU) per gram of dry lignocellulosic material will generally be suitable; when employing peroxidases, an amount thereof in the range of 0.02–2000 peroxidase units (PODU) per gram of dry lignocellulosic material will generally be suitable.

Determination of Oxidase and Peroxidase Activity

The determination of oxidase (e.g. laccase) activity is based on the oxidation of syringaldazin to tetramethoxy azo bis-methylene quinone under aerobic conditions, and 1 LACU is the amount of enzyme which converts 1 $\mu$M of syringaldazin per minute under the following conditions: 19 $\mu$M syringaldazin, 23.2 mM acetate buffer, 30° C., pH 5.5, reaction time 1 minute, shaking; the reaction is monitored spectrophotometrically at 530 nm.

With respect to peroxidase activity, 1 PODU is the amount of enzyme which catalyses the conversion of 1 $\mu$mol of hydrogen peroxide per minute under the following conditions: 0.88 mM hydrogen peroxide, 1.67 mM 2,2'-azinobis (3-ethylbenzothiazoline-6-sulfonate), 0.1M phosphate buffer, pH 7.0, incubation at 30° C.; the reaction is monitored photometrically at 418 nm.

Oxidizing Agents

The enzyme(s) and oxidizing agent(s) used in the process of the invention should clearly be matched to one another, and it is clearly preferable that the oxidizing agent(s) in question participate(s) only in the oxidative reaction involved in the binding process, and does/do not otherwise exert any deleterious effect on the substances/materials involved in the process.

Oxidases, e.g. laccases, are, among other reasons, well suited in the context of the invention since they catalyze oxidation by molecular oxygen. Thus, reactions taking place in vessels open to the atmosphere and involving an oxidase as enzyme will be able to utilize atmospheric oxygen as oxidant; it may, however, be desirable to forcibly aerate the reaction medium during the reaction to ensure an adequate supply of oxygen.

In the case of peroxidases, hydrogen peroxide is a preferred peroxide in the context of the invention and is suitably employed in a concentration (in the reaction medium) in the range of 0.01–100 mM.

pH in the Reaction Medium

Depending, inter alia, on the characteristics of the enzyme (s) employed, the pH in the aqueous medium (reaction medium) in which the process of the invention takes place will be in the range of 3–10, preferably in the range 4–9.

The present invention also relates to a lignocellulose-based product obtainable by a process according to the invention as disclosed herein.

EXAMPLES

The ferulylated arabinoxylan used in the examples (often referred to below simply as arabinoxylan) below was obtained from G B Gels Ltd, Swansea, Wales, UK. The laccase employed was *Trametes villosa* laccase, produced by Novo Nordisk A/S, Bagsvaerd, Denmark.

Example 1

Hard boards (1000 kg/m$^2$) of birch NSSC pulp were formed in a PFI sheet mould. The wet board was pressed at room temperature to a dry matter content of 50%.

After pressing, the boards were placed on a net and immersed in different solutions. In all cases, the boards were immersed for 90 seconds. The temperature of the solutions was 20° C.

The different treatments were as follows:

Arabinoxylan:
- immersed in a solution of ferulylated arabinoxylan (0.6% w/w).

Arabinoxylan+laccase:
- immersed in a freshly made solution of ferulylated arabinoxylan (0.6% w/w) and laccase (1 LACU/ml).

After immersion, the boards were left at room temperature for 5 minutes and then pressed at room temperature to a dry matter content of around 50%. The wet boards were pressed in a hot press for 5 minutes at 180° C. to form a hard board. All the boards were pressed to a thickness of 3 mm.

The boards were tested for bending strength [MOE (modulus of elasticity) and MOR (modulus of rupture)] according to the European Standard EN 310:1993. The results are listed in the table below. The values are the average of results obtained for the two sides of the boards produced by the wet fibreboard process.

| | MOE (GPa) | MOR (MPa) |
|---|---|---|
| Arabinoxylan | 3.64 | 42.7 |
| Arabinoxylan + laccase | 4.16 | 59.0 |

It is seen that the MOE and MOR values for the board produced according to the invention are much higher than the values obtained when adding only ferulylated arabinoxylan to the fibres.

Example 2

Handsheets of pine TMP pulp (160 g/m$^2$) were made in a PFI sheet mould. The sheets were then pressed in a sheet press for 5 minutes at a pressure of 400 kPa. After pressing, the wet sheets were placed on a net and immersed in different solutions. In all cases the sheets were immersed for 90 seconds, and the temperature of the solutions was 20° C.

The different treatments were as follows:

Control:
- immersed in water

Laccase:
- immersed in a solution of laccase (0.1 LACU/ml).

Arabinoxylan:
- immersed in a solution of ferulylated arabinoxylan (0.6% w/w).

Arabinoxylan+laccase:
- immersed in a freshly made solution of ferulylated arabinoxylan (0.6% w/w) and laccase (0.1 LACU/ml).

After immersion, the sheets were left at room temperature for 5 minutes and then pressed in the sheet press for 5 minutes at a pressure of 400 kPa. After pressing, the sheets were dried in a sheet dryer. The drying lasted 5 minutes.

Thickness and tensile index were measured for the sheets according to the SCAN standards SCAN-P7 and SCAN-P16. the results are given below. It is clearly seen that the sheets treated according to the invention are much stronger than the control and the sheets treated with only one of the components.

The results of the thickness measurement indicate that the treatment according to the invention also prevent "spring-back" of the sheet when the pressure is released after the final pressing. It is observed that the thickness of the sheets treated according to the invention is only half that of the control and reference sheets.

| | Tensile index (Nm/g) | Thickness (μm) |
|---|---|---|
| Control | 8.106 | 694 |
| Arabinoxylan | 7.309 | 639 |
| Laccase | 5.257 | 682 |
| Arabinoxylan + Laccase | 46.95 | 350 |

A qualitative test of the wet strength demonstrated that the sheets produced according to the invention have significantly higher tensile strength than the controls after immersion in tap water for 3 hours.

Example 3

Two pieces of birch wood were uniformly coated with a solution containing ferulylated arabinoxylan (2% w/w) and laccase (0.25 LACU/ml) on the sides to be bonded. The two pieces were pressed together at a pressure of 400 KPa at room temperature for 30 minutes.

Two sets of control experiments were made: one with only laccase in the solution and one with only the arabinoxylan in the solution. The pieces were treated as described above.

After drying/hardening, the bonding strength was measured according to the DIN standard.

| | Bond strength |
|---|---|
| Only laccase added | The pieces did not adhere |
| Only arabinoxylan added | 0.4 MPa |
| Arabinoxylan + laccase added | 1.6 MPa |

It is clearly seen that the process according to the invention gives a much better adhesive effect than obtained when adding only one of the two active components (i.e. the laccase and the ferulylated arabinoxylan).

We claim:

1. A process for the manufacture of a lignocellulose product, comprising the steps of:

(a) mixing in a reaction medium, a phenolic polysaccharide with lignocellulose, wherein the polysaccharide is substituted with a phenolic hydroxy group; and (b) adding to the mixture of (a) an enzyme capable of catalyzing the oxidation of phenolic groups in the presence of an oxidizing agent.

2. The process according to claim 1, wherein said lignocellulose product is selected from the group consisting of fibre board, particle board, flakeboard, plywood and moulded composites.

3. The process according to claim 1, wherein said lignocellulose product is selected from the group consisting of paper and paperboard.

4. The process according to claim 1, wherein said lignocellulose is selected from the group consisting of vegetable fibre, wood fibre, wood chips, wood flakes and wood veneer.

5. The process according to claim 1, wherein the phenolic substituent is selected from the group consisting of p-coumaric acid, p-coumaryl alcohol, coniferyl alcohol, sinapyl alcohol, ferulic acid and p-hydroxybenzoic acid.

6. The process according to claim 1, wherein the polysaccharide portion of the phenolic polysaccharide is selected from the group consisting of modified and unmodified starches, modified and unmodified cellulose, and modified and unmodified hemicelluloses.

7. The process according to claim 1, wherein said phenolic polysaccharide is selected from the group consisting of ferulylated arabinoxylans and ferulylated pectins.

8. The process according to claim 1, wherein a reaction medium containing said lignocellulose, said phenolic polysaccharide and said enzyme is incubated in the presence of said oxidizing agent for a period of from 1 minute to 10 hours.

9. The process of claim 8, wherein the enzyme is incubated in the presence of said oxidizing agent for a period of from 1 minute to 2 hours.

10. The process according to claim 1, wherein said enzyme is selected from the group consisting of oxidases and peroxidases.

11. The process according to claim 1, wherein said enzyme is an oxidase selected from the group consisting of laccases (EC 1.10.3.2), catechol oxidases (EC 1.10.3.1) and bilirubin oxidases (EC 1.3.3.5), and said oxidizing agent is oxygen.

12. The process according to claim 11, wherein said enzyme is a laccase and is used in an amount in the range of 0.02–2000 LACU per g of dry lignocellulose.

13. The process of claim 11, wherein the mixture of step (b) is aerated.

14. The process of claim 11, wherein said enzyme is a laccase obtained from a fungus of the genus Botrytis, Myceliophthora, or Trametes.

15. The process of claim 14, wherein the fungus is *Trametes versicolor* or *Trametes villosa*.

16. The process according to claim 1, wherein said enzyme is a peroxidase and said oxidizing agent is hydrogen peroxide.

17. The process according to claim 16, wherein said peroxidase is used in an amount in the range of 0.02–2000 PODU per g of dry lignocellulose, and the initial concentration of hydrogen peroxide in the medium is in the range of 0.01–100 mM.

18. The process according to claim 1, wherein the amount of lignocellulose employed corresponds to 0.1–90% by weight of the reaction medium, calculated as dry lignocellulose.

19. The process according to claim 1, wherein the temperature of the reaction medium is in the range of 10°–120° C.

20. The process of claim 19, wherein the temperature of the reaction medium is in the range of 15°–90° C.

21. The process according to claim 1, wherein an amount of phenolic polysaccharide in the range of 0.1–10% by weight.

22. The process according to claim 1, wherein the pH in the reaction medium is in the range of 3–10.

23. The process of claim 22 wherein the pH in the reaction medium is in the range of 4–9.

24. A lignocellulose product obtainable by the process according to claim 1.

* * * * *